US005226593A

United States Patent [19]

Beryozkin et al.

[11] Patent Number: 5,226,593

[45] Date of Patent: Jul. 13, 1993

[54] METHOD AND MEANS OF HEATING SPACE AREAS AND OBJECTS

[76] Inventors: Vladimir L. Beryozkin, 245 N. Main St., New City, N.Y. 10956; Ilya Gurevich, 2628 E. 18 St., Brooklyn, N.Y. 11235

[21] Appl. No.: 819,401

[22] Filed: Jan. 10, 1992

[51] Int. Cl.[5] ..... F24C 9/00

[52] U.S. Cl. ..... 237/1 R; 126/247

[58] Field of Search ..... 126/247; 237/1 R; 416/244 R

[56] References Cited

U.S. PATENT DOCUMENTS

| | | | |
|---|---|---|---|
| 3,467,179 | 9/1969 | Teves et al. | 126/247 X |
| 3,807,383 | 4/1974 | Lawler | 126/247 |
| 4,040,769 | 8/1977 | Britz | 416/244 R |
| 4,299,198 | 11/1981 | Woodhull | 126/247 |
| 4,483,277 | 11/1984 | Perkins | 126/247 X |
| 4,696,283 | 9/1987 | Kohlmetz et al. | 126/247 |
| 5,046,480 | 9/1991 | Harris | 126/247 |
| 5,056,502 | 10/1991 | Eyzaguirre et al. | 126/247 |

*Primary Examiner*—William E. Tapolcai
*Attorney, Agent, or Firm*—Ilya Zborovsky

[57] ABSTRACT

A method and means of heating industrial, residential space, area and objects without heaters, for example, electrical, gas, oil and coal burners, based on the conversion of such a cooling device as centrifugal impeller into a major element of a heat generator built into an insulated enveloped circulating system; the impeller transforms its rotational energy and its losses into heat and circulates and heats air inside the system; air circulating in the insulated closed loop system becomes the source of uniform heat for a space, area and objects.

4 Claims, 4 Drawing Sheets

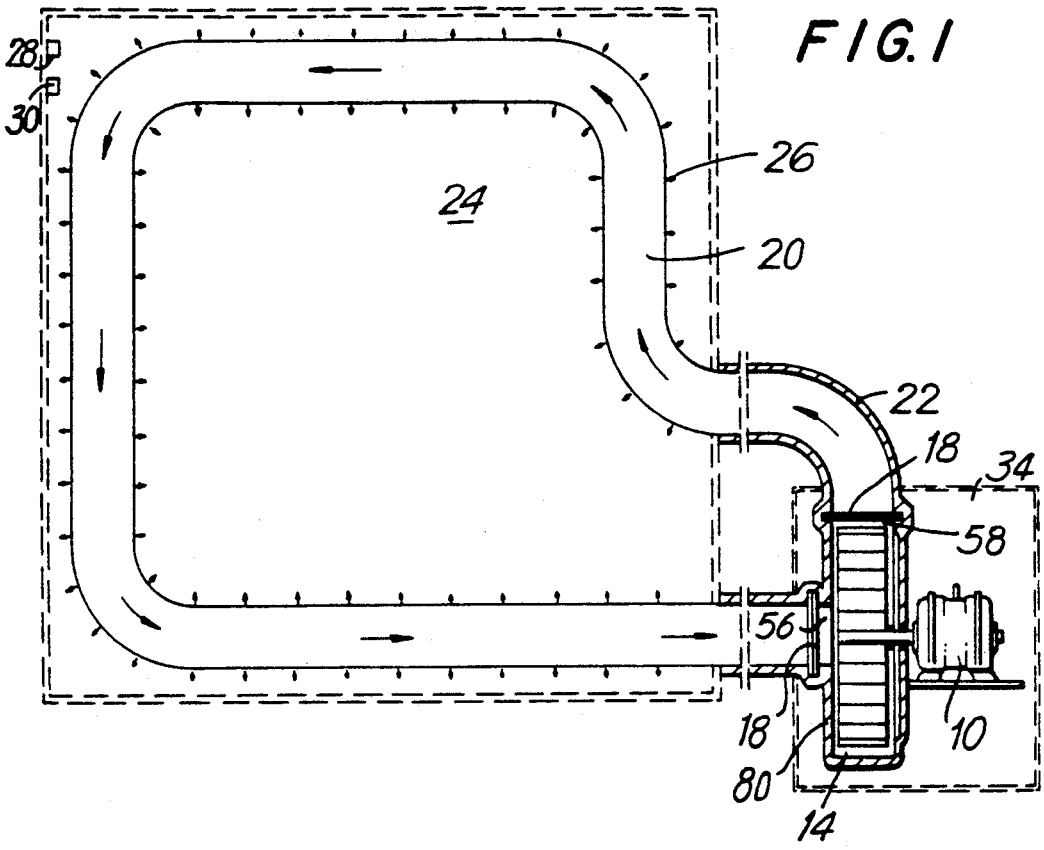
FIG. 1
FIG. 2A
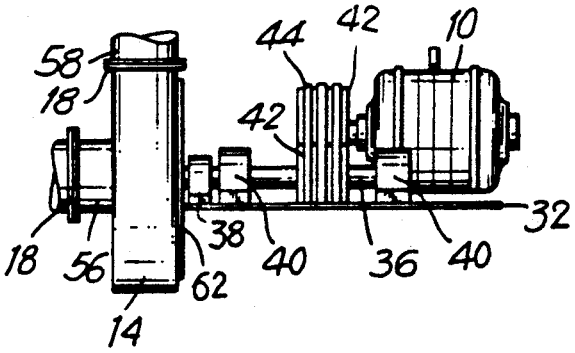
FIG. 2B
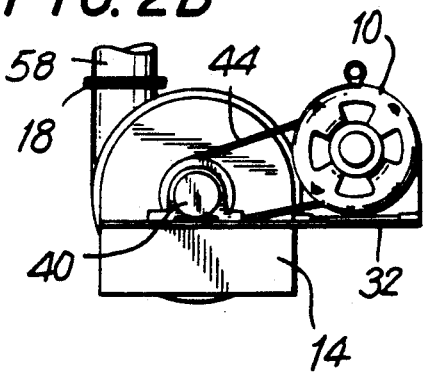
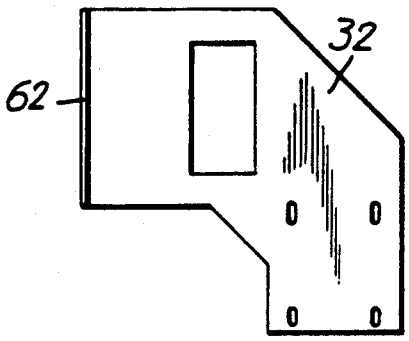
FIG. 2C

METHOD AND MEANS OF HEATING SPACE AREAS AND OBJECTS

BACKGROUND OF THE INVENTION

The present invention relates to devices for heating industrial and residential space areas and objects. The invention can also be used for heating glass, painted surfaces, etc., and also in agriculture for drying grains, heating life stock sheds, green houses, etc., and finally for propulsion of various machines.

Devices of the above mentioned general type are known in the art. The known devices use gas, oil, electric current, coal, furnace burning, fans for air circulation, electric heaters. The above described devices have a very low efficiency due to frequent cycling which leads to the excessive losses of heated air and combustion products escaping through chimneys and smoke stacks. The efficiency of the systems for industrial purposes ranges within 15–25%. The cost of energy for operating a blower fan constitutes over 20% of the total operating cost.

The existing electric conventional heaters use an electric spiral as a heating element and they do not uniformly heat the surrounding area. They also significantly change the chemical composition of air and reduce humidity. The conventional electric heaters have also low efficiency. The furnace burning systems are very expensive due to their required large physical size and high cost of gas, oil and electricity. The systems create one of the most serious environmental problems, namely air pollution.

More efficient heating systems have been developed. In order to increase the efficiency of the systems, U.S. Pat. No. 4,090,061 discloses an apparatus for heating and delivery of air by a fan and an electric heating element formed as a stationary cylindrical cage of spaced longitudinal air guide vanes made of an electrically resistant alloy. The air passing through the impeller and the guiding vanes of the cage is heated electrically to a required temperature. U.S. Pat. No. 4,295,606 discloses a self-starting, heat powered air heating system. It is a closed loop-type vapor generator filed by a modulating gas burner controlled to fire at a rate proportional to the demand within the space to be heated. A vapor powered turbine is directly connected to receive the output from the generator to operate at a variable speed in response to the demand level within the space. Vapor exhaust from the turbine is conducted through a condenser, where it gives up its heat and becomes liquid, and then returns the vapor generator. Air from heating a space is conducted over the condenser by a fan directly driven at a variable speed by the turbine.

Impellers or fans are always used for cooling. They are also used for providing air pressure as a carrier of air. While performing their functions, impellers and fans use up to 20% of their capacity to overcome various kinds of resistance.

The designs described above have various disadvantages and problems namely complex and costly design which includes multiple systems such as fuel circuits, environmental air circuit, electric circuit, vacuum modulating circuit for controls, resistors, etc., as well as several stages of conversion of liquid. They have low efficiency due to frequent cycling which in most industrial systems 15–25%. It has large physical size. They are characterized by excessive losses of heated air and combustion products through smoke stacks in chimneys leading to air pollutions and acid rain, they have high cost of fuel, high cost of maintenance and repair, they require one or several operators, they are characterized by significant losses of energy, and their efficiency is only 30–50%.

SUMMARY OF THE INVENTION

Accordingly, it is an object of the present invention to provide a device for heating, which avoids the disadvantages of the prior art.

More particularly, it is an object of the present invention to provide a device for heating which is simple and inexpensive, has high efficiency, is characterized by minimum losses of energy, minimum cost of operation, maintenance and repair, operate automatically without operators, do not have negative environmental impact, and have relatively small constructions.

In keeping with these objects and with others which will become apparent hereinafter, one feature of the present invention resides, briefly stated, in a device for heating which has an impeller providing constant return, recycling and mixing of the same volume of air in an insulated closed loop system without use of heaters.

When the device is designed in accordance with the present invention, the humidity and chemical composition of air is not changed because the space in the system is not heated by a heating element but instead is heated by a heat carrier. Air circulates in the closed loop circulating system and transforms a maximum energy consumed by the rotation of the impeller to heat.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a view schematically showing a device for heating in accordance with the present invention;

FIGS. 2A–2C and 2D are views showing a heat generator assembly and a plan view of a base plate of the inventive device;

DESCRIPTION OF THE PREFERRED EMBODIMENTS

Figure 2D:
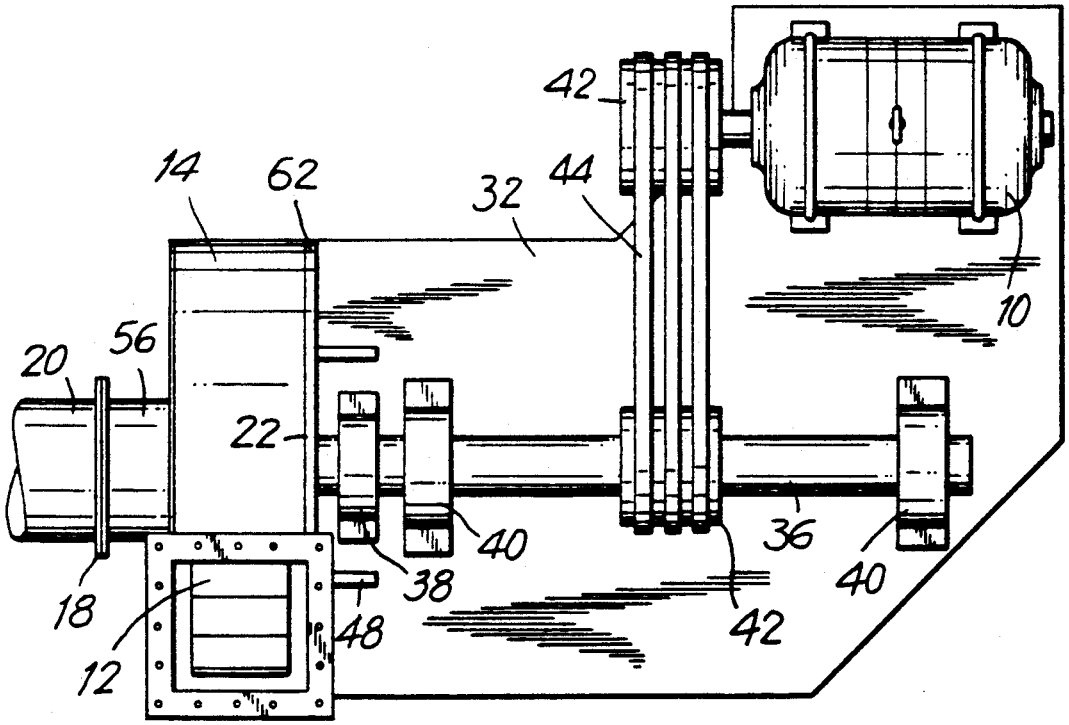

A device for heating in accordance with the present invention has a closed loop insulated system for heating as shown in FIG. 1. The device has a heat generator 34, air ducts 20, extending from and to the heat generator, connecting flanges 18, a heat exchange area 24, heat radiators 26, and insulation 24 for the ducts 20 and a heat generator chamber 14. Air ducts 20 are insulated up to the points where they are connected with the heat exchange area 24. In the heat exchange area 24 the air ducts 20 are provided with the heat radiators 26 for accelerating the heat transfer. The ducts are connected with the flanges 18.

FIGS. 2A–2D show an embodiment of the heat generator 34. The heat generator 34 has the chamber 14, a base plate 22, an electric motor 10, an impeller 12, an impeller shaft 64, a bearing cooler 38, a bearing support 40, sheaves 42 and an inlet 56, an air outlet 58, V-shaped belts 44 and the insulation 22. The heat generator is also provided with a thermostat 28 and an electronic control 30 shown in FIG. 1. The sheaves 42 are mounted on a motor shaft 10 and on a connecting shaft 36 and connected with the belts 44. By properly calculating, sizing and selecting the above mentioned units and components, it is possible to match the power of electric motor and the size of the impeller with the required heat output. As shown in FIGS. 2A–2D and 3, elements can be used such as for example the two sheaves 42, the V-shaped belts 44, the connecting shaft 36, the bearing supports 40 and a safety collar 50. The base plate 32 can be composed of low carbon steel and have ½–¾ inch thickness. It has holes for insulating purposes and is also provided with a vertical bracket 52 and bracket stiffeners 48 for attaching of the heat chamber 14. The brackets and the stiffeners are also composed of low carbon steel. For preventing undesirable vibrations of the equipment in the base plate 32, a vibration proof material formed as thick rubber pads should be installed in the base plate 32 and the foundation.

Figure 3:
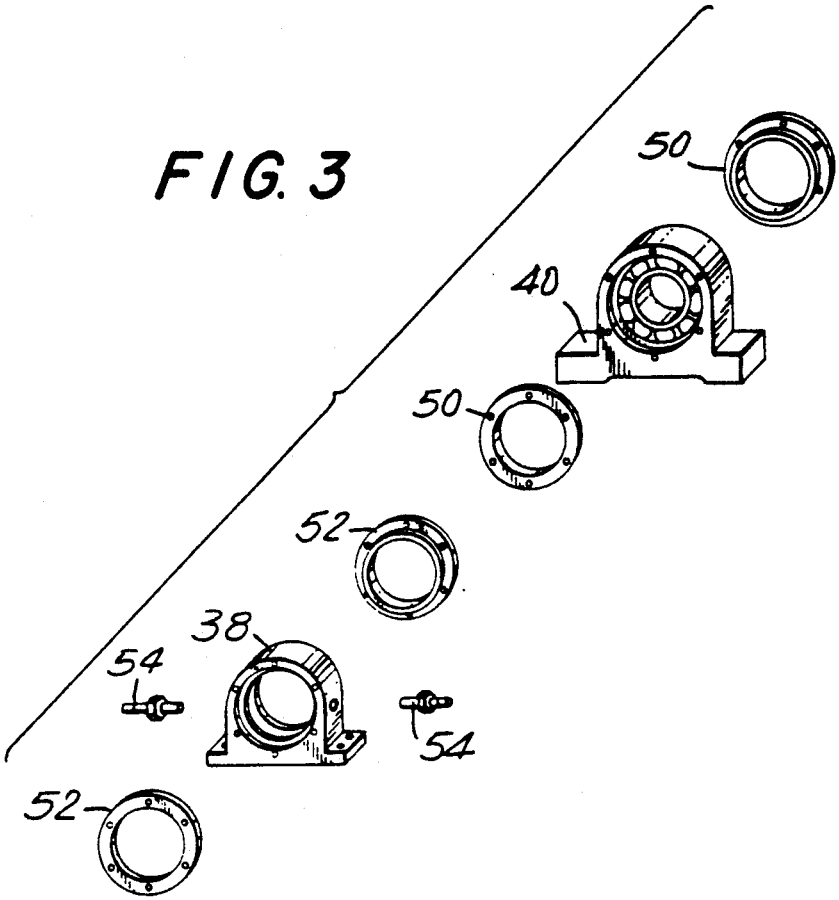
FIG. 3 is a perspective view of elements of bearing supports and a cooler assembly of the inventive device.

FIG. 3 shows an assembly which includes the bearing support 40 and the bearing collar 38 with two covers 52. The cooler 38 has two water inlet and water outlet fittings 54, and protects the shaft bearing support 40 of the impeller from overheating.

Figure 4A:
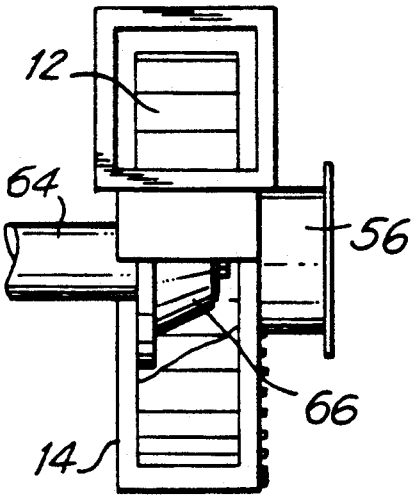
FIG. 4 shows various views of a chamber and an impeller assembly in accordance with a further embodiment of the present invention.
Figure 4B:
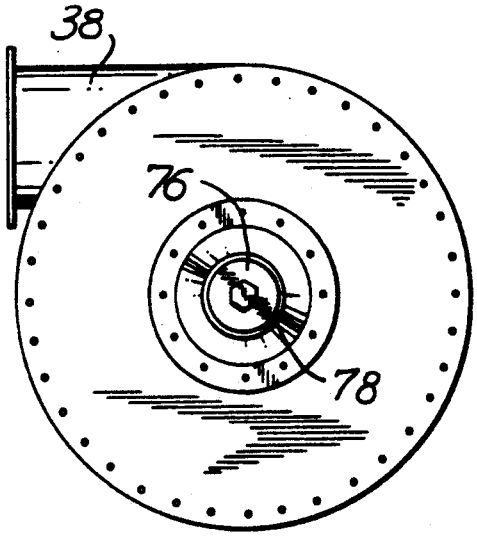

As can be seen from FIGS. 4A, 4B, the heat chamber 14 is composed of a welded metal box with double walls 18 and fiber glass ½–¾ inch insulation 22 between the walls. The walls 18 can be composed of heat resistant stainless steel ⅛ inch thickness for internal walls and 1/16 inch thickness for external walls. Each wall 80 has the walls for the impeller shaft 64 and an air inlet 36 and an air outlet 58 with the flanges 18. The chamber 14 is bolted to the bracket 62 and the base plate 32. The bracket 62 has stiffeners 48 for its reinforcement.

Figure 5A:
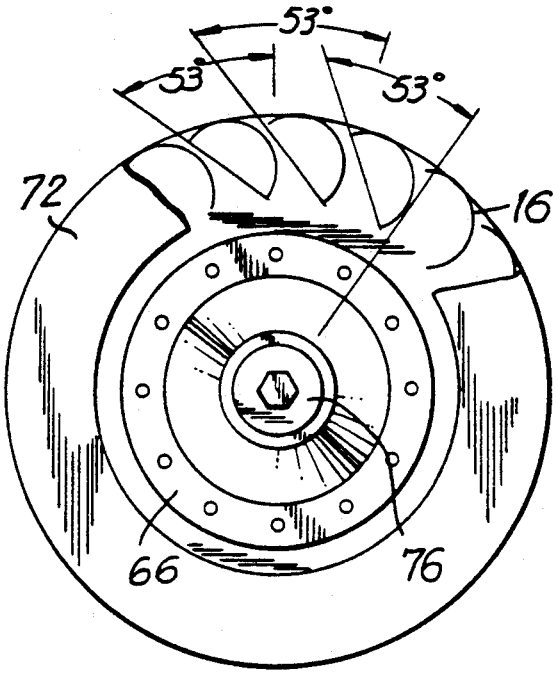
FIGS. 5A and 5B are end and side views showing an impeller assembly in accordance with a further embodiment of the invention.
Figure 5B:
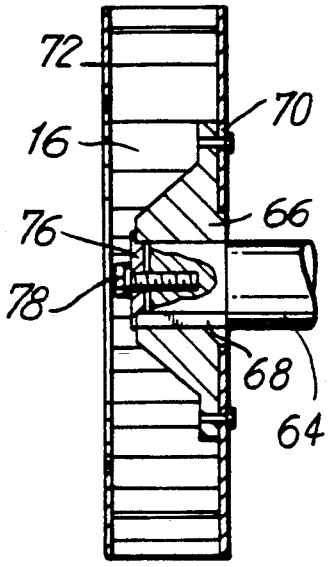
Figure 5C:
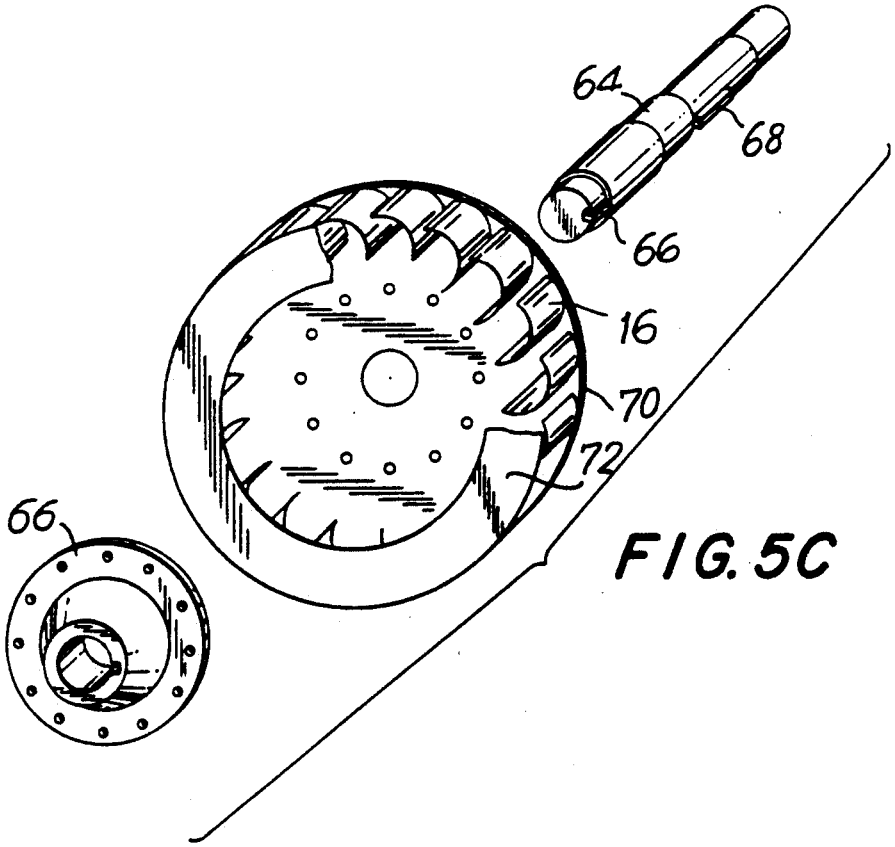
FIG. 5C is a perspective view of parts of the impeller in accordance with the further embodiments.

FIGS. 5A–5C show the assembly of the impeller 12 including a shaft 64 with two keys 68, vanes 16, a flange 66, and an assembly disc 70, a coupling 74, a stop disc 76, a stop bolt 78 and an assembly ring 72. The disc 70, the ring 72 and the vanes 16 are composed of heat resistant stainless steel. The vanes 16 are attached to the disc 70 and the ring 72 by welding. The shaft 64 is composed of chromium magnesium steel. The keys 68, the flange 66, the stop disc 76 and the stop bolt 78 can be composed of medium carbon steel.

The impeller 12 is mounted on the coupling 74 which is arranged on the shaft 64 and attached to the flange 66. The shaft 64 is attached to the connecting shaft 36 and has the bearing support 38. FIG. 5A also shows the impeller vane. Every vane 16 has a special profile and is welded to the assembly disc 70 and assembly ring 72 by welding at 53° from the vertical axis of the impeller.

The device in accordance with the present invention operates in the following manner:

The motor 10 drives the sheaves 42 with the belts 44 and therefore transfers rotational energy to the connecting shaft 36 and the impeller shaft 64. The impeller 12 driven by the motor 10 makes approximately 3,000 revolutions per minute. Its specially designed vanes 16 create strong turbulent movement of air and an air pressure in the insulating chamber 14. The impeller vanes 16 have a special profile and are installed at 53° relative to the vertical axis. This design enables the impeller to create maximum air turbulence, resistance and molecular friction. During this process the temperature of the air increases within 5–15 minutes. The air heated in the chamber 14 is directed to the outlet 58 connected with the insulated air ducts 20. Through the insulated air ducts, the hot air is conveyed to the heat exchange area 24 and the heat radiators 26. Due to the closed-loop system the air from the heat exchange area 24 with the lower temperature is returned to the insulated air chamber 14 through the inlet 56 and is turbulently mixed and heated again with the air which is already heated in the chamber to approximately 176° F. or 80° C. or higher. The molecular friction of air accelerates the heating process.

Thus, a cooling device formed as a centrifugal impeller or fan is a major element of a heat generator. The high speed rotation of the especially designed impeller 12 provides turbulent movement of air, air pressure and molecular friction of air, and reduces constant return, recycling and mixing of the same volume of air in the insulated closed-loop system.

The above process can be repeated in a continuous manner as long as required, and is regulated by the thermostat 28 connected with the motor 10 and the electronic control 30. The control 30 receives high and low demand signals from the thermostat 28 and therefore switches on or off the motor.

When the heating device is designed in accordance with the present invention, it has a high efficiency of approximately 80–90%, low cost and simple design, it has no negative environmental impact, no necessity for large, costly and complicated construction, no requirement for human operation, it also has low cost of maintenance and repair and operates without affecting the humidity and chemical composition of air.

It will be understood that each of the elements described above, or two or more together, may also find a useful application in other types of constructions differing from the types described above.

While the invention has been illustrated and described as embodied in a device for heating, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for heating air, comprising a closed-loop duct system; and means mixing and circulating air in said system so as to heat the air due to produced turbulent movement of air, air pressure and molecular friction of air, said means including an impeller providing mixing and circulating of air in said closed-loop duct system and having an impeller shaft, an electric motor for driving said impeller and having a motor shaft; two connecting shafts connected to said impeller shaft and to said electric motor shaft respectively; two sheaves arranged so that one of said sheaves is mounted on said motor shaft and another of said sheaves is mounted on one of said connecting shafts, connecting means for conveying rotational energy from one of said sheaves to another of said sheaves, bearing cooling means for said impeller shaft, means for supporting said impeller and said connecting shafts, a base plate provided with a vertical bracket and two stiffeners for supporting said impeller, vibration proof means provided between said base plate and a foundation for preventing excessive vibrations.

2. A device as defined in claim 1, wherein said closed-loop system includes a plurality of air ducts; flanges for connecting said air ducts with one another, heat exchange radiators provided on said ducts, and means for controlling temperature of air in said ducts, said ducts forming an area of heat exchange.

3. A device as defined in claim 1, wherein said impeller has an assembly disc, an assembly ring, and a plurality of vanes connected with said assembly disc and said assembly ring.

4. A device as defined in claim 3, wherein said vanes have an arched channeled profile for scooping air and are located at a 53° relative to a vertical axis of said impeller.

* * * * *